US007319314B1

(12) United States Patent
Maheshwari et al.

(10) Patent No.: US 7,319,314 B1
(45) Date of Patent: Jan. 15, 2008

(54) REPLICA REGULATOR WITH CONTINUOUS OUTPUT CORRECTION

(75) Inventors: Sanjeev Maheshwari, San Jose, CA (US); Babak Taheri, San Francisco, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 11/313,342

(22) Filed: Dec. 21, 2005

Related U.S. Application Data

(60) Provisional application No. 60/639,009, filed on Dec. 22, 2004.

(51) Int. Cl.
*G05F 3/16* (2006.01)
*G05F 3/20* (2006.01)

(52) U.S. Cl. ..... 323/313; 323/316; 327/543

(58) Field of Classification Search ..... 323/313, 323/314, 315, 316; 327/541, 543
See application file for complete search history.

(56) References Cited

U.S. PATENT DOCUMENTS 5,661,395 A 8/1997 Johnson et al.
6,157,178 A 12/2000 Montanari
6,249,177 B1 6/2001 Savage et al.
6,373,231 B1 4/2002 Lacey et al.
6,424,131 B1 * 7/2002 Yamamoto et al. ..... 323/282
6,441,593 B1 8/2002 Saripella
6,501,256 B1 * 12/2002 Jaussi et al. ..... 323/315
6,601,936 B2 8/2003 McDonald
7,002,401 B2 * 2/2006 Khalid ..... 327/541
7,009,374 B2 * 3/2006 Neaves ..... 323/317
7,026,802 B2 * 4/2006 Gradinariu ..... 323/316
7,106,042 B1 * 9/2006 Jackson ..... 323/316
2005/0134242 A1 6/2005 Gradinariu

* cited by examiner

*Primary Examiner*—Bao Q. Vu
(74) *Attorney, Agent, or Firm*—Brownstein Hyatt Farber Schreck, P.C.

(57) ABSTRACT

Circuits for regulating a voltage or current to a load(s). In one example, a circuit may include a first amplifier providing an amplifier output signal, the first amplifier having at least a first input and a second input, the first input receiving a voltage reference signal; a first transistor receiving the amplifier output signal, the first transistor having a transistor output; at least one resistor coupled between the transistor output and the second input of the first amplifier and defining a feedback voltage signal node; a second transistor in parallel with the first transistor, the second transistor receiving the amplifier output signal, the second transistor providing a regulated output signal of the circuit; a second amplifier receiving the output signal of the second transistor and the transistor output of the first transistor, the second amplifier providing a control signal; and a circuit element coupled between the feedback voltage signal node and ground, the circuit element receiving as a control the control signal of the second amplifier.

19 Claims, 6 Drawing Sheets

REPLICA REGULATOR WITH CONTINUOUS OUTPUT CORRECTION

CROSS REFERENCE TO RELATED APPLICATION

This application claims priority under 35 U.S.C. 119(e) to U.S. Provisional Patent Application No. 60/639,009 entitled "Replica Regulator with Continuous Output Correction" filed Dec. 22, 2004, the disclosure of which is hereby incorporated by reference in its entirety.

FIELD OF THE INVENTION

The present invention relates generally to electronic circuits, and more particularly to regulator circuits.

BACKGROUND OF THE INVENTION

Regulator circuits are widely used in integrated circuit designs to provide an internal power supply or supply reference (such as a voltage or current) which, ideally, decouples the external applied power supply voltage (to the first order) as well as load on the supply pins of the chip A first conventional n-channel replica regulator 20 solution is shown in FIG. 1. The regulator 20 takes a voltage input, and provides two separate voltage outputs for analog and digital logic (outa and outd respectively). This conventional replica architecture 20 may suffer from poor load regulation, as no information about the output voltage is available to the regulator core. The poor load regulations are worse at minimum input voltage levels and load current values.

A second conventional n-channel replica regulator 40 with 1-bit ADC correction is shown in FIG. 2. The 1-bit ADC provides feedback to the resistance stack R1, R2, R3 in the regulator core, performing a coarse correction to the output voltage. In the event where the load current increases, the analog output will fall below the replica reference voltage shown as OUTREF. This will pull comparator output COMP low and introduce extra resistance R1, which in turn will increase replica reference voltage OUTREF and thus increase the output voltages OUTa and OUTb. However, this scenario will cause an abrupt change in output voltage with increasing load current, and will degrade load regulation.

These replica regulators 20, 40 can be stabilized across a large range of output load current and load capacitance. However, these conventional replica regulator implementations 20, 40 can suffer from poor load regulation and poor peak load current capability.

Accordingly, as recognized by the present inventors, what is needed is a regulator circuit that can provide large output load currents without substantially degrading load regulation.

It is against this background that various embodiments of the present invention were developed.

SUMMARY

In light of the above and according to one broad aspect of an embodiment of the present invention, disclosed herein is a circuit for regulating an output signal provided to a load. In one example, the circuit may include a first amplifier providing an amplifier output signal, the first amplifier having at least a first input and a second input, the first input receiving a voltage reference signal; a first transistor receiving the amplifier output signal, the first transistor having a transistor output; at least one resistor coupled between the transistor output and the second input of the first amplifier and defining a feedback voltage signal node; a second transistor in parallel with the first transistor, the second transistor receiving the amplifier output signal, the second transistor providing a regulated output signal of the circuit; a second amplifier receiving the output signal of the second transistor and the transistor output of the first transistor, the second amplifier providing a control signal; and a circuit element coupled between the feedback voltage signal node and ground, the circuit element receiving as a control the control signal of the second amplifier.

The circuit element may take various forms. In one embodiment, the circuit element may include a second resistor and a third transistor, the third transistor having a gate coupled with the control signal of the second amplifier, the third transistor coupled in parallel with the second resistor. In another embodiment, the circuit element may include a third transistor and a fourth transistor, the fourth transistor having a gate coupled with the control signal of the second amplifier, the fourth transistor coupled in parallel with the third transistor. In another embodiment, the circuit element may include a first current source coupled with and responsive to the control signal of the second amplifier, and may also include a second current source coupled in parallel with the first current source. In one example, the second current source provides a fixed current.

In other embodiments, the circuit may also include a third transistor in parallel with the second transistor, the third transistor receiving the amplifier output signal, the third transistor providing a second regulated output signal of the circuit. The transistors may be implemented using n-channel transistors, if desired.

In another embodiment, the second amplifier may be configured to receive a second reference voltage and the output signal of the second transistor.

In accordance with another broad aspect of another embodiment of the present invention, disclosed herein is a regulator circuit. In one example, the regulator circuit may include a first amplifier providing an amplifier output signal, the first amplifier having at least a first input and a second input, the first input receiving a voltage reference signal; a first transistor receiving the amplifier output signal, the first transistor having a transistor output; at least one resistor coupled between the transistor output and the second input of the first amplifier and defining a feedback voltage signal node; a second transistor in parallel with the first transistor, the second transistor receiving the amplifier output signal, the second transistor providing a regulated output signal of the circuit; a second amplifier receiving the transistor output of the second transistor, the second amplifier providing a control signal; a circuit element coupled between the feedback voltage signal node and ground; and a third transistor coupled in parallel with the second transistor, the third transistor having a gate coupled with the control output of the second amplifier, the third transistor having an output coupled with the output of the second transistor. The circuit element may be implemented as a resistor if desired.

The features, utilities and advantages of the various embodiments of the invention will be apparent from the following more particular description of embodiments of the invention as illustrated in the accompanying drawings.

DETAILED DESCRIPTION

Disclosed herein are various embodiments of a circuit for providing a regulated output signal. In one embodiment, a replica regulator is disclosed which has continuous current feedback, and a second control or feedback mechanism is provided to improve the robustness of the regulated output signal.

In one example, the regulator circuit continuously corrects for diminishing output voltage, with increasing output load current, by current feedback to regulator core, thereby providing load regulation due to this continuous correction.

The load regulation can be further adjusted by second loop gain and feedback amount. In one example, the second loop comprises a second operational-amplifier and transistor, which can enable the regulator circuit to supply large peak load current without increasing the standby current of the regulator core. Various embodiments of the present invention are disclosed herein.

Figure 1:
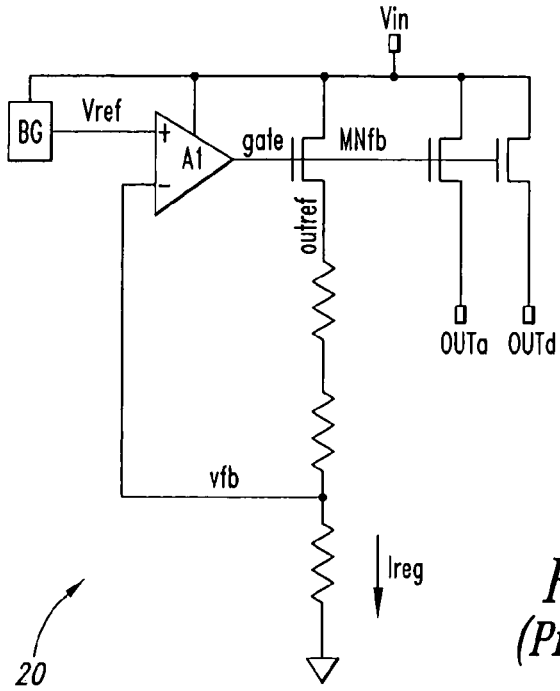
Fig. 1 (Prior Art)
FIG. 1 is a schematic diagram of a conventional regulator circuit.
Figure 2:
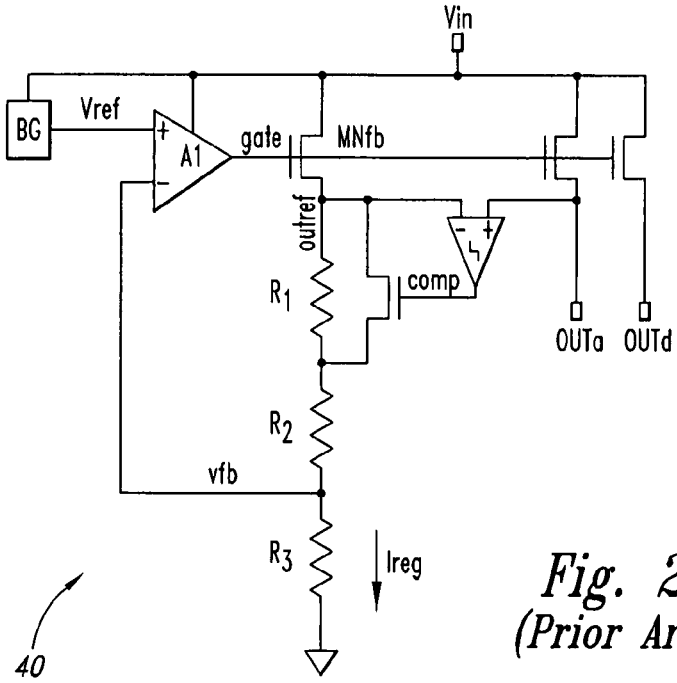
Fig. 2 (Prior Art)
FIG. 2 is a schematic diagram of another conventional regulator circuit.
Figure 3:
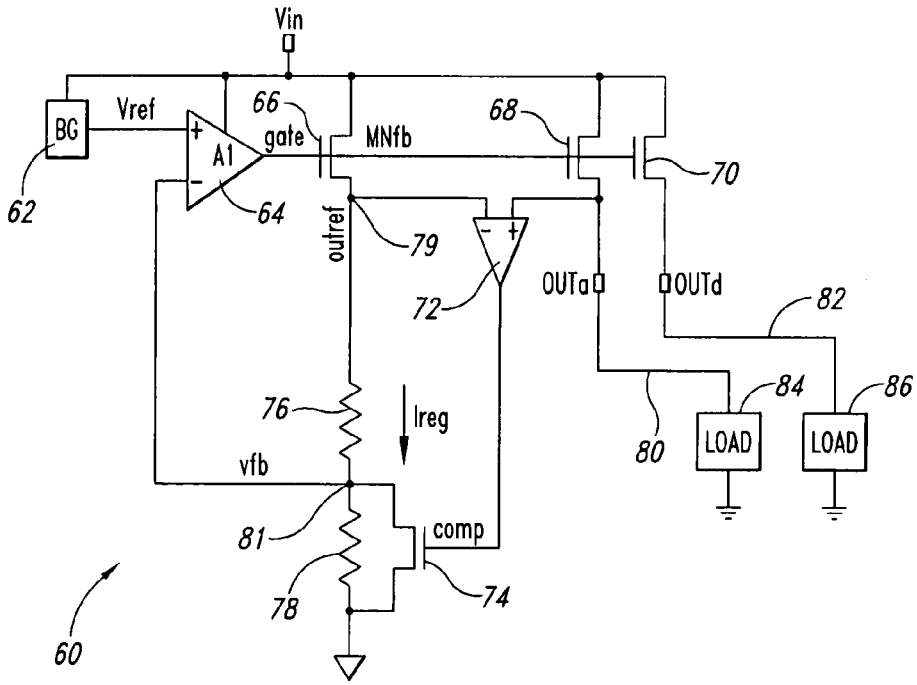
FIG. 3 is an example of a regulator circuit according to an embodiment of the present invention.

FIG. 3 illustrates one embodiment of the present invention wherein a replica regulator circuit 60 is illustrated. In one example, circuit 60 may include a band gap voltage reference circuit 62 which provides and generates a voltage reference shown as VREF. Operational amplifier 64 receives, on its non-inverting input, the reference voltage from the band gap voltage reference circuit 62. The output of amplifier 64 is coupled with the gates of N channel transistors 66, 68, and 70. Transistors 66, 68, 70 have their drains coupled with an input supply voltage shown as VIN. In one embodiment, two output transistors 68, 70 are provided which each provide an regulated current output, respectively shown as output 80, 82 which may be used to drive different loads 84, 86, if desired. In another embodiment, transistor 70 may be omitted.

As shown in FIG. 3, the source of transistor 66 is coupled with the series connected resistors 76, 78, wherein resistor 78 is coupled with ground. A regulation current IREG flows through transistor 76 and generates an output reference voltage shown as OUTREF, 79. A node 81 is formed between resistors 76, 78 and provides a voltage feedback signal shown as VFB which is coupled with the inverting input of amplifier 64.

In the embodiment of FIG. 3, a second operational amplifier or comparator 72 may be utilized for providing a second feedback loop. In one example, the non-inverting input of amplifier 72 is couple with the output reference signal 79, and the inverting input of amplifier 72 may be coupled with the output 80 of the circuit 60. The output of amplifier 72 provides a signal (shown as the COMP signal) that may be coupled with the gate of an N channel transistor 74 which has its drain and source coupled across resistor 78.

Operational amplifier 64 provides a feedback mechanism to correct errors and monitor the output 80 in order to maintain the output 80 directly and 82 indirectly at a given voltage level desired for the implementation.

Transistor 66 acts as a replica transistor, and along with the resistors 76 and 78, provides a replica regulator current, shown as IREG, that is used to bias the feedback of op amp 64. IREG replicates or tracks the current that flows into the load 84.

Resistors 76, 78 form a voltage divider, and close the negative feedback loop of the amplifier 64. The node 81 has the VFB signal that is tapped by op amp 64 as negative feedback to op amp 64 and forms a virtual ground (relative to the vref)

The first feedback loop may include amplifier 64, transistor 66, resisters 76, 78.

The second feedback loop may include transistor 68, transistor 66, transistor 74 and amplifier 72. As shown, transistors 68 and 70 are not in the feedback path of op amp 64.

In overall operation, the bang gap voltage reference 62 provides the VREF signal to the positive input of op amp 64, and based on the transistor 66, resistor 76, 78, the op amp feedback tries to force its output (shown as GATE) to a level that matches the gate voltage on transistors 66, 68.

Op amp 72, which is also connected to transistors 68, 66, controls transistor 74 and provides a secondary feedback loop. This secondary feedback corrects for the output of transistor 68 (OUTA) so that it does not fall below a voltage limit received by amplifier/comparator 72. In one example, amplifier 72 compares the signal 79 (OUTREF) of transistor 66 to the output signal 80 (OutA) of transistor 68, and if the output 80 of transistor 68 falls below signal 79 (OUTREF), amplifier/comparator 72 turns on transistor 74 (which would be a linear mode of operation) and reduces or changes the value of resistance 78.

By changing the resistance 78, the first feedback loop will adjust its output (the GATE signal on amp 64) in order to make sure that the output 80 (OUTA) of transistor 68 is not below the output 79 of transistor 66.

The secondary feedback loop basically kicks in or starts functioning when the output 80 of the regulator circuit 60 falls below a desired value for the regulator circuit 60.

Hence, circuit 60 permits control over the output 80 (OUTA) as the load 84 on output 80 increases.

As mentioned above, output 80 (OUTA) can be used to drive a load 84, which can be an analog load if desired. Typically, digital loads are less than sensitive to voltage variations, and hence output 82 may be used for digital loads. Since the output 72 changes resistor 78 and causes the gate voltage of transistor 66 and 68 to change, the secondary feedback loop also has an effect on transistor 70 since the gate of transistor 70 is connected to the gate of transistors 66, 68 (in one example, transistors 68 and 70 are identical). If desired, output 82 can also be provided with a secondary feedback loop in order to improve the regulation of output 82.

Embodiments of the present invention may utilize a boost current feedback (IBST) to the regulator core. This IBST increases the core current in response to the increasing load current requirements, and can correct for reducing output voltage because of increasing load current requirements.

Figure 4:
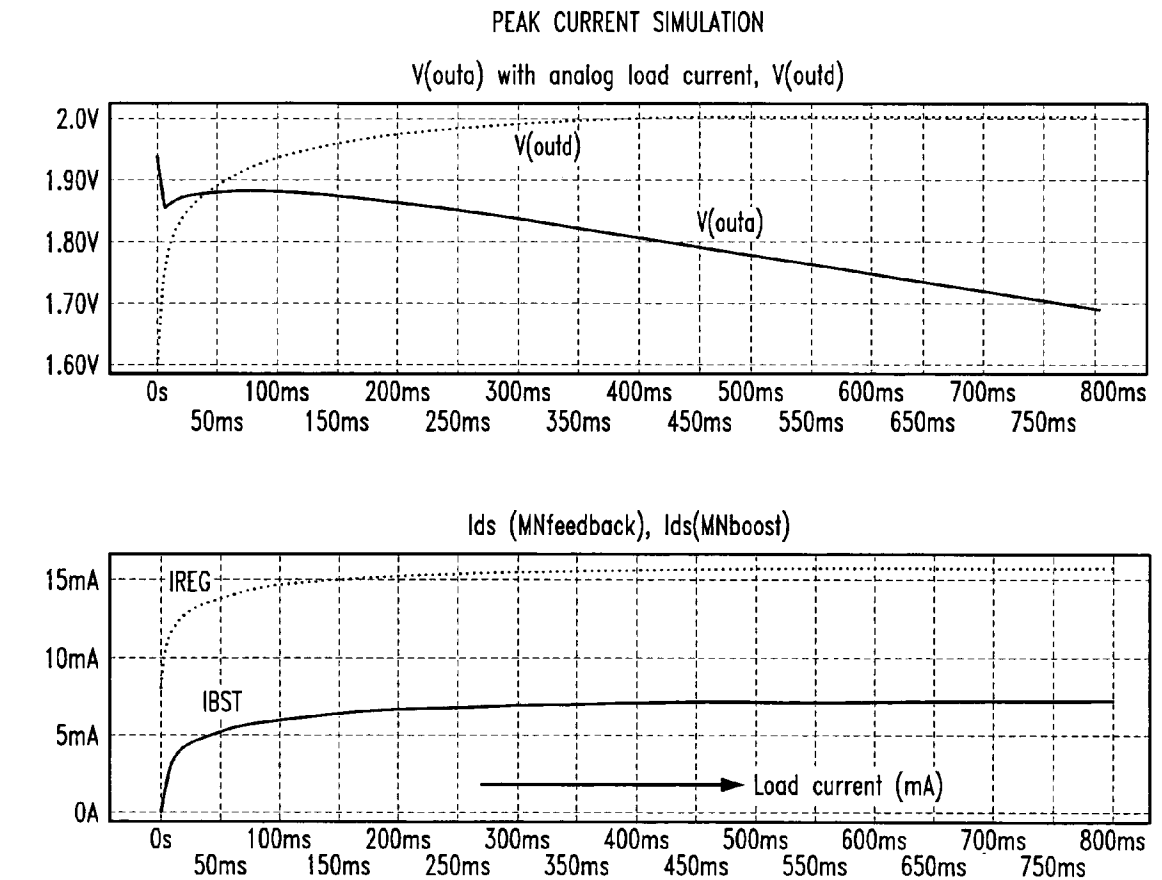
FIG. 4 is an example simulation waveforms for a regulator circuit in accordance with an embodiment of the present invention, FIG. 4 showing output voltages with increasing output load currents.

This can be seen in FIG. 4 where boost current IBST increases with increasing load current. This correction in turn improves load regulation, and allows a large peak current capability without the need of large standby current burn in the regulator core.

FIG. 4 shows on the top portion, a graph the output voltages V(outa) analog output, and V(outd) digital output. The top graph shows how these vary as the load current increases. The bottom graph shows the boost feedback current (IBST) and main regulator core current (IREG). The response of the boost current can be adjusted through the gain of the feedback loop, in one example.

Stated differently, FIG. 3 illustrates an example of a circuit 60 for regulating an output signal 80 provided to a load 84. In one example, the circuit 60 may include a first amplifier 64 providing an amplifier output signal (GATE), the first amplifier 64 having at least a first input and a second input, the first input receiving a voltage reference signal (i.e., VREF from bandgap voltage reference 62); a first transistor 66 receiving the amplifier output signal, the first transistor 66 having a transistor output 79; at least one resistor 76 coupled between the transistor output 79 and the second input (i.e., the inverting input) of the first amplifier 64 and defining a feedback voltage signal node 81; a second transistor 68 in parallel with the first transistor 66, the second transistor 68 receiving the amplifier output signal, the second transistor 68 providing a regulated output signal 80 of the circuit 60; a second amplifier 72 receiving the output signal 80 of the second transistor 68 and the transistor output 79 of the first transistor 66, the second amplifier 72 providing a control signal (shown as COMP); and a circuit element 83 coupled between the feedback voltage signal node 81 and ground, the circuit element 83 receiving as a control the control signal (i.e., COMP) of the second amplifier 72.

The circuit element 83 may take various forms. In one embodiment, the circuit element 83 may include a second resistor 78 and a third transistor 74, the third transistor 74 having a gate coupled with the output signal of the second amplifier 72, the third transistor 74 coupled in parallel with the second resistor 78.

In another embodiment, for example shown in FIG. 5 and described below, the circuit element 83 may include a third transistor 74 and a fourth transistor 102, the third transistor 74 having a gate coupled with the control signal output of the second amplifier 72, the fourth transistor 102 coupled in parallel with the third transistor 74.

In another embodiment, for example shown in FIG. 6 and described below, the circuit element 83 may include a first current source 124 coupled with and responsive to the control signal output of the second amplifier 72, and may also include a second current source 122 coupled in parallel with the first current source 124. In one example, the second current source 122 provides a fixed current.

In other embodiments, a regulator circuit may also include a third transistor 70 in parallel with the second transistor 68, the third transistor 70 receiving the amplifier output signal from amplifier 64, the third transistor 70 providing a second regulated output signal 82 of the circuit.

In another embodiment, for example shown as FIG. 7 and described below, the second amplifier 72 may be configured to receive a second reference voltage (shown as VREF2) and the output signal of the second transistor 68.

Figure 5:
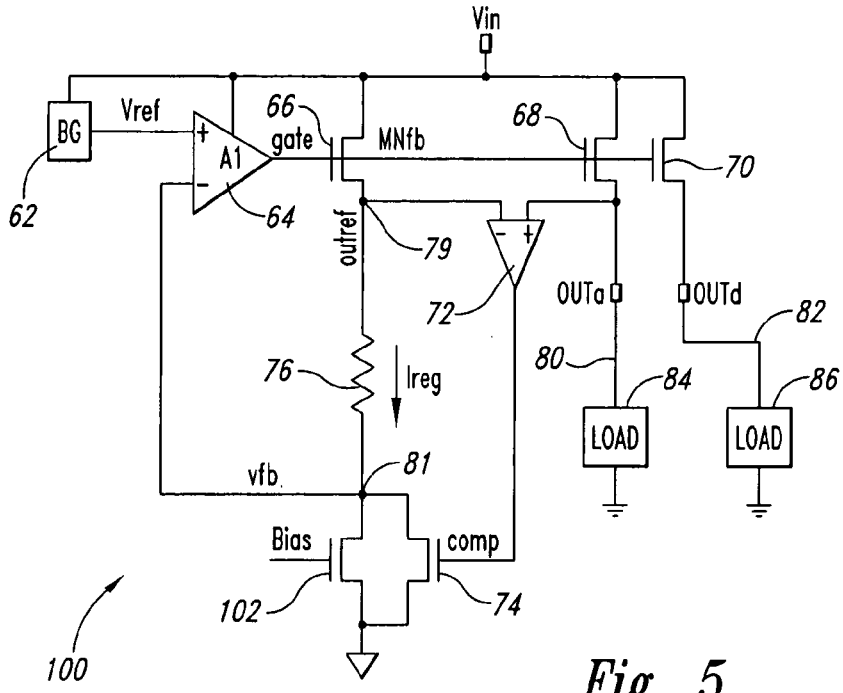
FIG. 5 is another example of a regulator circuit, according to an embodiment of the present invention.

FIG. 5 illustrates another embodiment of the present invention, wherein a replica regulator 100 may employ a similar architecture as circuit 60 of FIG. 3. In FIG. 5, the circuit 100 replaces resistor 78 of FIG. 3 with a transistor, such as N channel transistor 102, which can be utilized to control the amount of current flow from node 81 to ground, thereby controlling the voltage feedback signal received by amplifier 64.

In FIG. 5, rather than having a fixed voltage divider at the output of amplifier 64, by adding transistor 102, the voltage feedback signal VFB into amplifier 64 can be controlled or programmed by the bias voltage applied to the gate of transistor 102.

Figure 6:
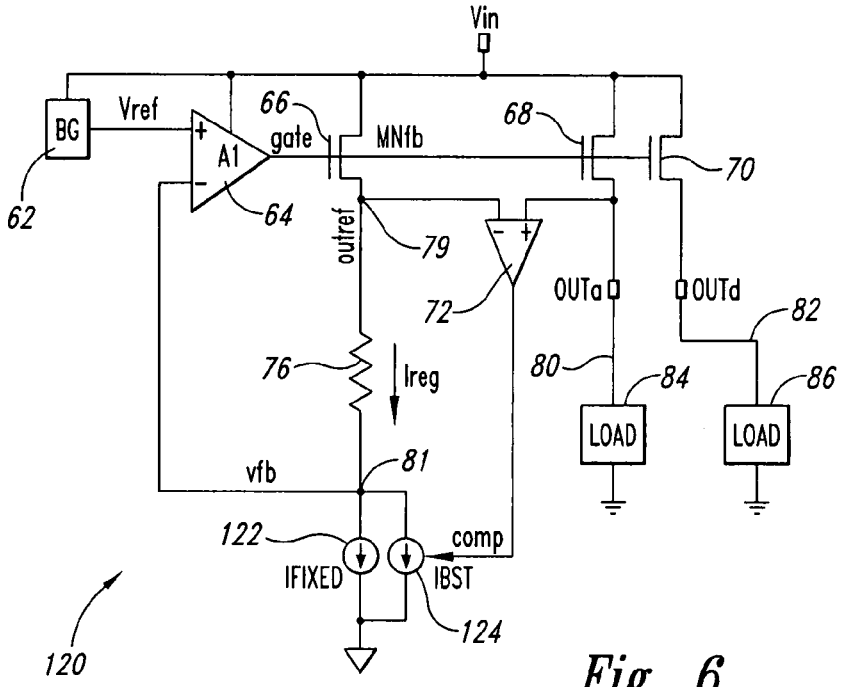
FIG. 6 is another example of a regulator circuit, according to an embodiment of the present invention.

FIG. 6 illustrates another embodiment of the present invention wherein a replica regulator circuit 120 is shown. Circuit 120 may employ a similar architecture as circuit 60 of FIG. 3, generally. In FIG. 6, circuit 120 replaces resistor 78 and transistor 74 of FIG. 3 with current sources 122 and 124 as shown in FIG. 6. In FIG. 6, the output of amplifier 72 controls the current source 124, and, when coupled in parallel with a preferable fixed current source 122, amplifier 72 can regulate the amount of current flowing from node 81 to ground, thereby controlling the voltage feedback signal VFB, which is coupled with amplifier 64.

In FIG. 6, the current sources 122, 124 can take the form of a single transistor to a very complicated programmable current source depending upon the implementation.

Figure 7:
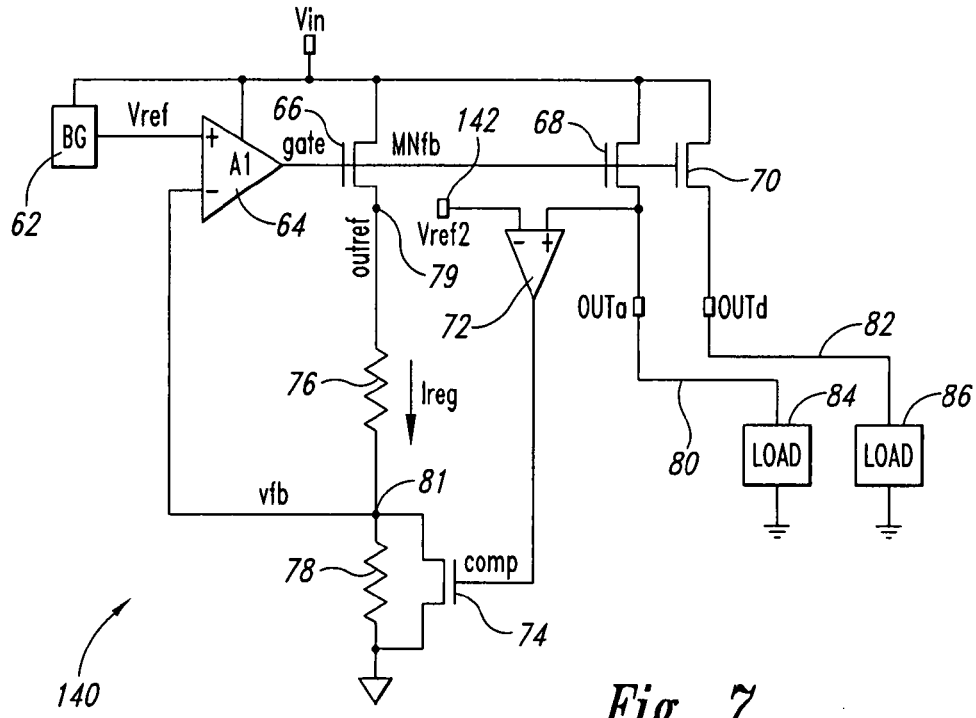
FIG. 7 is another example of a regulator circuit, according to an embodiment of the present invention.

FIG. 7 illustrates another embodiment of the present invention wherein a replica regulator circuit 140 is provided. Circuit 140 may employ, in general, a similar architecture as circuit 60 of FIG. 3. In circuit 140, the output reference signal 79 is decoupled from the non-inverting input of amplifier 72 of the FIG. 3. As shown in FIG. 7, the non-inverting input to amplifier 72 may be coupled with a voltage reference, shown as VREF2 (142), which may be provided as a fixed or desired voltage reference value, depending upon the implementation. The reference voltage 142 can control the second feedback loop. By decoupling the first feedback loop output reference signal 79 with amplifier 72 of the second feedback loop, circuit 140 of FIG. 7 may provide greater flexibility in terms of design and stability. The operations of amplifier 72 can be less dependent on the first feedback loop.

Figure 8:
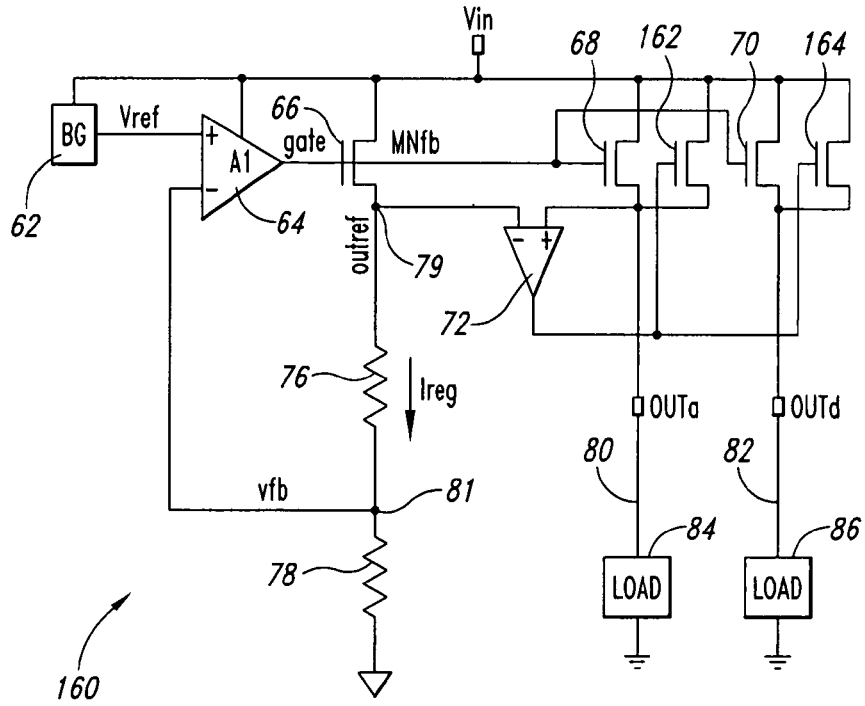
FIG. 8 is another example of a regulator circuit, according to an embodiment of the present invention.

FIG. 8 illustrates another embodiment of a replica regulator circuit 160 in accordance with one embodiment of the present invention. Circuit 160 may employ a generally similar architecture as circuit 60 of FIG. 3. In FIG. 8, circuit 160 omits transistor 74 of FIG. 3. Moreover, transistor 162 has been added in parallel with transistor 68, wherein the drain of transistor 162 is coupled with the drain of transistor 68, and the sources of transistors 68 and 162 are coupled together. Likewise, transistor 164 is provided in parallel with transistor 70, wherein the drains and sources of transistors 70, 164 are coupled together.

The gates of transistor 68, 70 are coupled together as previously shown in FIG. 3. In FIG. 8, the gates of transistors 162, 164 are coupled with and driven by the output of amplifier 72.

In FIG. 8, by adding parallel devices 162, 164 and adjusting the gate voltages applied to these transistors, the output voltages 80, 82 (OUTA, OUTD) can be dynamically adjusted, without affecting the resistor 78.

This embodiment provides another mechanism for decoupling the first feedback loop from the second feedback loop. Stated differently, feedback is provided to the drains of the drive transistors 68, 70 rather than to regulator core itself. Here, the feedback loop from amplifier 72 modulates the output strength rather than the core current strength.

Figure 9:
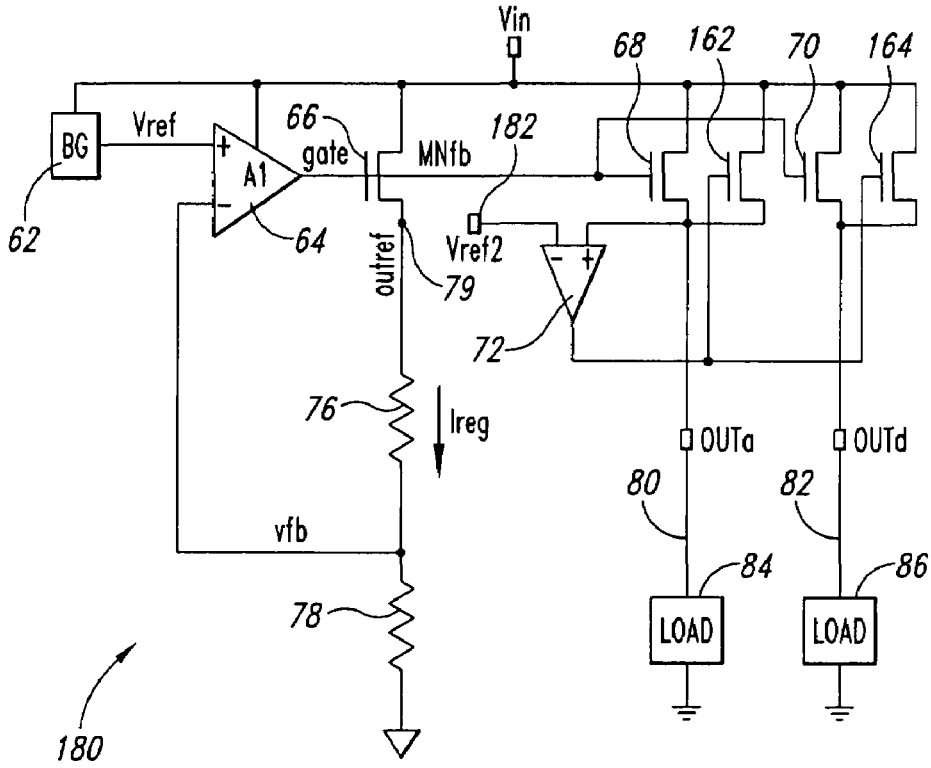
FIG. 9 is another example of a regulator circuit, according to an embodiment of the present invention.

FIG. 9 illustrates another embodiment of the present invention wherein a replica regulator circuit 180 is illustrated. Circuit 180 may be formed generally as circuit 160 of FIG. 8. The non-inverting input to amplifier 72 may be decoupled from the first feedback loop, and instead coupled with a voltage reference signal shown as VREF 2. In this embodiment, such a design can provide greater flexibility and stability depending upon the particular implementation.

Some advantages of some embodiments of the present invention include that a regulator core current may be increased when needed to supply large load current, but low standby current may be achieved when not large load currents are not required. As such, a regulator may be used in low standby-current environments while maintaining good load regulation and peak current capabilities. Further. embodiments of the present invention can be implemented without the need for area-expensive compensation capacitance.

Embodiments of the present invention may be used in various semiconductors, memories, processors, controllers, integrated circuits, logic or programmable logic, clock circuits, communications devices, and the like.

It is understood that the term "transistor" or "switch" as used herein includes any switching element which can include, for example, n-channel or p-channel CMOS transistors, MOSFETs, FETs, JFETS, BJTs, or other like switching element or device. The particular type of switching element used is a matter of choice depending on the particular application of the circuit, and may be based on factors such as power consumption limits, response time, noise immunity, fabrication considerations, etc. Hence while embodiments of the present invention are described in terms of p-channel and n-channel transistors, it is understood that other switching devices can be used, or that the invention may be implemented using the complementary transistor types.

Embodiments of the present invention can be implemented using p-channel transistors, or any combination of n-channel and p-channel transistors.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

It should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, as the following claims reflect, inventive aspects lie in less than all features of a single foregoing disclosed embodiment, and each embodiment described herein may contain more than one inventive feature.

What is claimed is:

1. A circuit for regulating an output signal provided to a load, comprising:

a first amplifier providing an amplifier output signal, the first amplifier having at least a first input and a second input, the first input receiving a voltage reference signal;

a first transistor receiving the amplifier output signal, the first transistor having a transistor output;

at least one resistor coupled between the transistor output and the second input of the first amplifier and defining a feedback voltage signal node;

a second transistor coupled with the first transistor, the second transistor receiving the amplifier output signal, the second transistor providing a regulated output signal of the circuit;

a second amplifier receiving the output signal of the second transistor and the transistor output of the first transistor, the second amplifier providing a control signal; and a circuit element coupled between the feedback voltage signal node and ground, the circuit element receiving as a control the control signal of the second amplifier, the circuit element further comprises a first current source coupled with and responsive to the control signal of the second amplifier.

2. The circuit of claim 1, wherein the circuit element further comprises:

a second resistor; and a third transistor, the third transistor having a gate coupled with the control signal of the second amplifier, the third transistor coupled with the second resistor.

3. The circuit of claim 1, wherein the circuit element further comprises:

a third transistor; and a fourth transistor, the fourth transistor having a gate coupled with the control signal of the second amplifier, the fourth transistor coupled with the third transistor.

4. The circuit of claim 1, further comprising:

a second current source coupled with the first current source.

5. The circuit of claim 4, wherein the second current source provides a fixed current.

6. The circuit of claim 1, further comprising:

a third transistor coupled with the second transistor, the third transistor receiving the amplifier output signal, the third transistor providing a second regulated output signal of the circuit.

7. The circuit of claim 1, wherein the first transistor is an n-channel transistor.

8. The circuit of claim 1, wherein the second transistor is an n-channel transistor.

9. A regulator circuit, comprising:

a first amplifier providing an amplifier output signal, the first amplifier having at least a first input and a second input, the first input receiving a voltage reference signal;

a first transistor receiving the amplifier output signal, the first transistor having a transistor output;

at least one resistor coupled between the transistor output and the second input of the first amplifier and defining a feedback voltage signal node;

a second transistor coupled with the first transistor, the second transistor receiving the amplifier output signal, the second transistor providing a regulated output signal of the circuit;

a second amplifier receiving a second reference voltage and the output signal of the second transistor, the second amplifier providing a control signal, the second reference voltage decoupled from the first amplifier; and a circuit element coupled between the feedback voltage signal node and ground, the circuit element receiving as a control the control signal of the second amplifier.

10. The regulator circuit of claim 9, wherein the circuit element further comprises:

a second resistor; and a third transistor, the third transistor having a gate coupled with the control signal of the second amplifier, the third transistor coupled with the second resistor.

11. The regulator circuit of claim 9, further comprising:

a third transistor coupled with the second transistor, the third transistor receiving the amplifier output signal, the third transistor providing a second regulated output signal of the circuit.

12. The regulator circuit of claim 9, wherein the first transistor is an n-channel transistor.

13. The regulator circuit of claim 9, wherein the second transistor is an n-channel transistor.

14. A regulator circuit, comprising:

a first amplifier providing an amplifier output signal, the first amplifier having at least a first input and a second input, the first input receiving a voltage reference signal;

a first transistor receiving the amplifier output signal, the first transistor having a transistor output;

at least one resistor coupled between the transistor output and the second input of the first amplifier and defining a feedback voltage signal node;

a second transistor coupled with the first transistor, the second transistor receiving the amplifier output signal, the second transistor providing a regulated output signal of the circuit;

a second amplifier receiving the transistor output of the second transistor, the second amplifier providing a control signal;

a circuit element coupled between the feedback voltage signal node and ground; and a third transistor coupled with the second transistor, the third transistor having a gate coupled with the control output of the second amplifier, the third transistor having an output coupled with the output of the second transistor.

15. The regulator circuit of claim 14, wherein the circuit element is a resistor.

16. The regulator circuit of claim 14, wherein the second amplifier also receives the transistor output of the first transistor.

17. The regulator circuit of claim 14, wherein the second amplifier also receives a second voltage reference signal.

18. The regulator circuit of claim 14, wherein the first, second and third transistors are n-channel transistors.

19. The regulator circuit of claim 14, wherein the third transistor is substantially identical to the second transistor.

* * * * *